United States Patent [19]

Walsworth

[11] 4,381,741

[45] May 3, 1983

[54] MECHANICAL FUEL PRESSURE OPERATED DEVICE FOR SUPPLYING A FUEL/OIL MIXTURE

[75] Inventor: Frank J. Walsworth, Waukegan, Ill.

[73] Assignee: Outboard Marine Corporation, Waukegan, Ill.

[21] Appl. No.: 309,558

[22] Filed: Oct. 8, 1981

[51] Int. Cl.[3] ..... F01M 3/00; F02B 33/06

[52] U.S. Cl. ..... 123/73 AD; 123/196 R; 184/6.28; 417/418

[58] Field of Search ..... 123/73 AD, 196 R; 184/6.28; 417/418

[56] References Cited

U.S. PATENT DOCUMENTS

| | | | |
|---|---|---|---|
| 2,935,057 | 5/1960 | Perlewitz | 123/73 AD |
| 2,938,509 | 5/1960 | Carbonero | 123/73 AD |
| 3,140,700 | 7/1964 | Nallinger | 123/73 AD |
| 3,976,040 | 8/1978 | Goggi | 123/73 AD |
| 4,142,486 | 3/1979 | Schreier | 123/73 AD |

*Primary Examiner*—Wendell E. Burns

*Attorney, Agent, or Firm*—Michael, Best & Friedrich

[57] ABSTRACT

Disclosed herein is a combined oil pumping and fuel supplying device comprising a housing including a variable volume discharge chamber which is adapted for fluid communication with a point of use and which varies in volume between a greater volume and a lesser volume, an inlet chamber which is adapted to communicate with a source of fuel under pressure and which varies in volume between a larger volume and a smaller volume, a valve communicating between the discharge chamber and the inlet chamber and operable between open and closed positions, structure for displacing the valve to the open position in response to contraction of the discharge chamber to the lesser volume, structure for displacing the valve to the closed position in response to contraction of the inlet chamber to the smaller volume, and a plunger responsive to variation in volume of one of the chambers toward one of the greater and lesser volumes for pumping oil for supply to a point of use.

17 Claims, 2 Drawing Figures

MECHANICAL FUEL PRESSURE OPERATED DEVICE FOR SUPPLYING A FUEL/OIL MIXTURE

BACKGROUND OF THE INVENTION

The invention relates generally to arrangements for supplying fuel and oil to two stroke internal combustion engines from separate fuel and oil sources. The invention also relates to arrangements for pumping of fuel or oil in response to the supply under pressure of the other of the fuel or oil and to arrangements for mixing the fuel and oil and for facilitating supply thereof in mixed condition to a two stroke internal engine, such as is used in a marine propulsion unit.

The invention also relates generally to arrangements for pumping one fluid from a first source in response to supply of a second fluid under pressure from a second source and for mixing the fluids and delivering such mixed fluids to a point of use.

In the past, outboard motors manufactured under the tradename SUZUKI have included an oil pump which was supplied oil from a tank accessible through the engine shroud, which was driven by a cam rotated by the engine, and which supplied the oil so pumped to the intake manifold for mixture with the incoming supply of fuel and for delivery of the thereby mixed fuel and oil to the engine crankcase.

Also in the past, it has been proposed to use electronic apparatus to effect oil pumping and mixing thereof with fuel prior to introduction to the engine crankcase. One such device was advertised by Injectronics Corp. of Spokane, Wash.

Also, in the past, the assignee hereof, has advertised and electronic fuel/lube oil metering kit for multi-cylinder outboard motors.

Attention is also directed to the Carlyle U.S. Pat. No. Re. 29,193 reissued Apr. 26, 1977, and directed to a fuel metering device, and to the Tucker U.S. Pat. No. 4,165,759, issued Aug. 28, 1979, both of which are directed to delivering measured quantities of liquid into a fluid.

SUMMARY OF THE INVENTION

The invention provides a combined oil pumping and fuel supplying device comprising a housing including means defining a variable volume discharge chamber which is adapted for fluid communication with a point of use and which varies in volume between a greater volume and a lesser volume, means defining an inlet chamber which is adapted to communicate with a source of fuel under pressure and which varies in volume between a larger volume and a smaller volume, valve means communicating between the discharge chamber and the inlet chamber and operable between open and closed positions, means displacing the valve means to the open position in response to contraction of the discharge chamber to the lesser volume, means displacing the valve means to the closed position in response to contraction of the inlet chamber to the smaller volume, and means responsive to variation in volume of one of the discharge chamber and the inlet chamber for pumping oil for supply to a point of use.

In one embodiment of the invention, the device further includes means for preventing volume variation of one of the discharge chamber and the inlet chamber in the absence of available oil supply to the oil pumping means.

In one embodiment of the invention, the means for preventing volume variation of one of the discharge chamber and the inlet chamber comprises an oil tank, a passage communicating between the oil tank and the oil pumping means, and valve means closing the passage in response to reduction below a predetermined level of the oil in the oil tank.

In one embodiment in accordance with the invention, the housing includes a partition separating the discharge chamber and the inlet chamber, the valve means includes a port in the partition and a valve member movable relative to the port between open and closed positions, the inlet chamber is formed, in part, by a movable wall having therein an orifice and including the valve member, the housing further defines, in combination with the movable wall, a regulator chamber, and further including means in the regulator chamber biasing the movable wall so as to locate the valve member in the closed position.

In one embodiment in accordance with the invention, the housing includes a partition separating the discharge chamber and the inlet chamber, the valve means includes a port in the partition and a valve member movable relative to the port between open and closed positions, the inlet chamber is formed, in part, by a movable wall having thereon means engageable with the valve member for displacing the valve member to one of the open and closed positions in response to displacement of the inlet chamber movable wall to a position establishing the accumulator chamber smaller volume, and the discharge chamber is formed, in part, by a movable wall having thereon means engageable with the valve member for displacing the valve member to the other of the open and closed positions in response to displacement of the discharge chamber movable wall to a position extablishing the discharge chamber lesser volume.

Other features and advantages of the embodiments of the invention will become known by reference to the following general description, claims and appended drawings.

IN THE DRAWINGS

Figure 2:
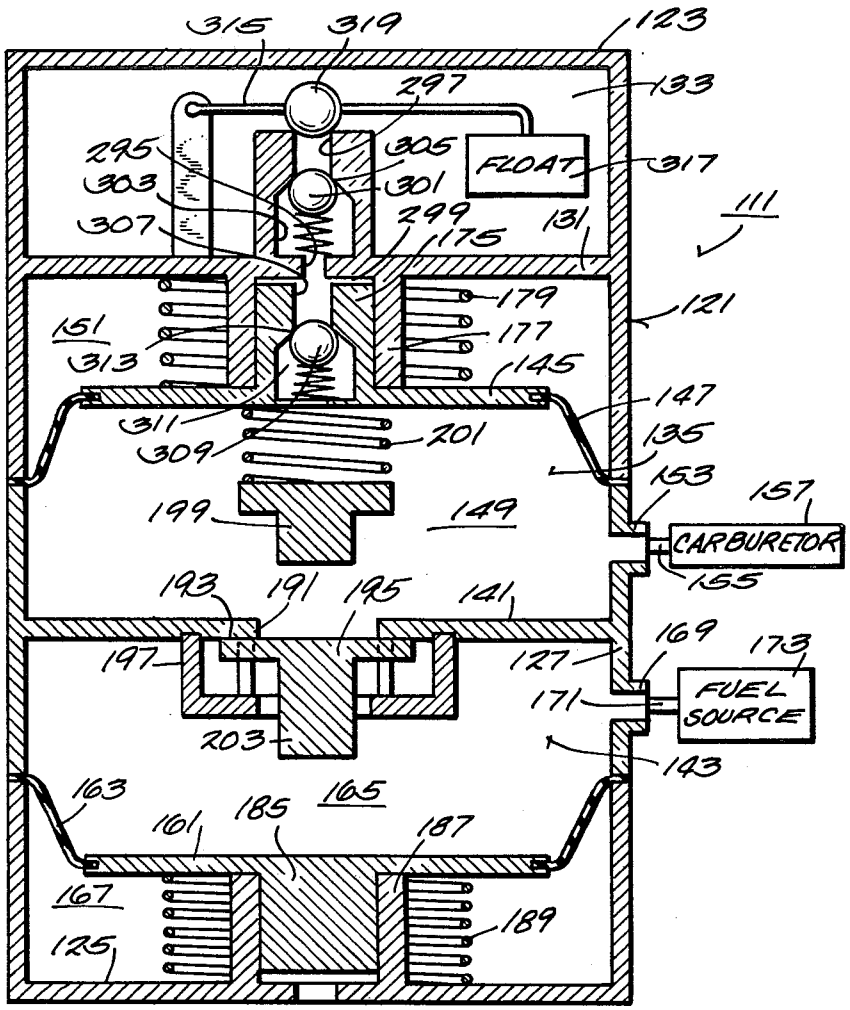
FIG. 2 is a schematic view of a second embodiment of a mechanical fuel pressure operated device for supplying a fuel/oil mixture.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 1:
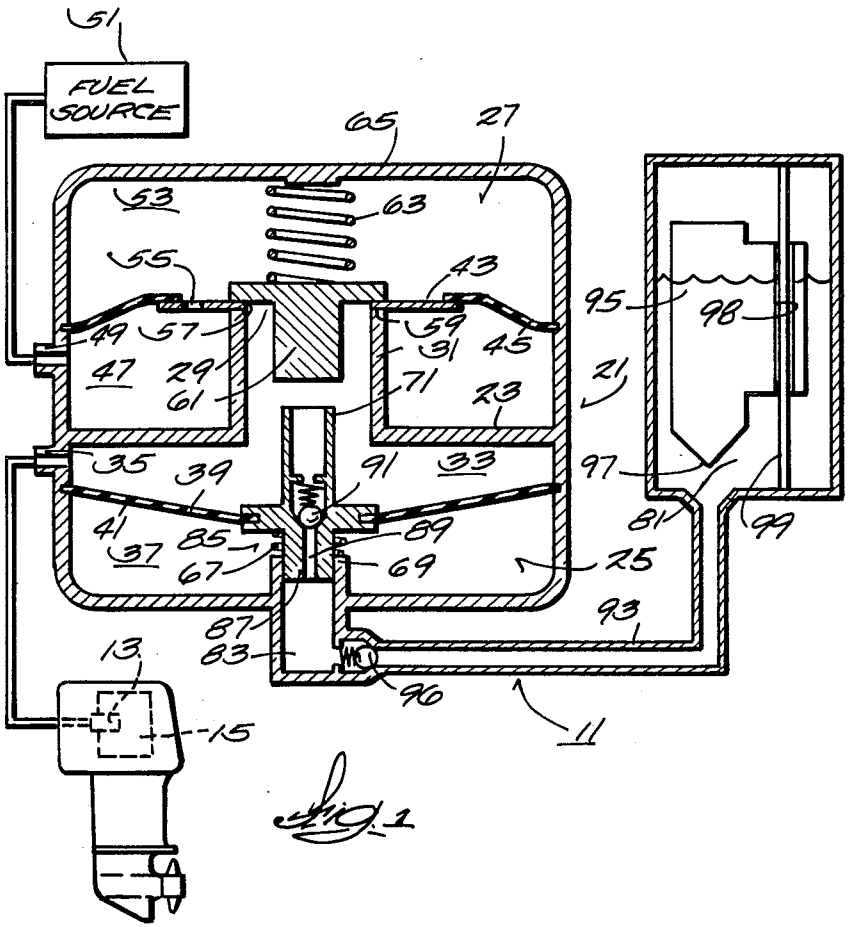
FIG. 1 is a schematic view of one embodiment of a mechanical fuel pressure operated device for supplying a fuel/oil mixture.

Shown schematically in FIG. 1 is an oil pumping and fuel/oil metering device 11 which is adapted for connection to separate fuel and oil supply sources and for supplying a fuel/oil mixture to a carburetor 13 of a two-stroke engine 15 in response to usage by the carburetor 13 of the fuel/oil mixture and in response to supply to the device of fuel under pressure.

While various other constructions are possible, in the illustrated construction, the device 11 comprises a hollow housing 21 which includes wall means including a partition 23 dividing the housing 21 into first and second recesses or chambers 25 and 27 which are communicable with each other through a port 29 in the partition. Preferably, as illustrated, the partition 23 includes an upstanding passage portion 31 and the port 29 is located at the outer end of the passage portion 31.

In turn, the first recess or chamber 25 is divided, by a diaphragm or piston 39 including, in part, a flexible membrane 41 secured peripherally to the housing 21, into a variable volume discharge chamber 33 including a fitting 35 adapted to communicate with the fuel bowl (not shown) of the carburetor 13 or other such device for supplying a fuel/oil mixture to the combustion chamber or chambers of a two-stroke engine and divided into a sub chamber 37.

The second recess or chamber 27 is also divided, by diaphragm or piston 43 including, in part, a flexible membrane 45 which is peripherally secured to the housing 21, into a fuel inlet chamber 47 including a fitting 49 adapted to communicate with a suitable source 51 of fuel under pressure, and an auxilary or regulating chamber 53. The diaphragm or piston 43 includes a restricted orifice 55 affording a limited rate of flow between the fuel inlet chamber 47 and the auxilary chamber 53 while, at the same time, approximately equalizing the fluid pressure in both the fuel inlet chamber 47 and the auxiliary chamber 55.

The diaphragm or piston 43 also includes a central opening 57 which, in general, registers with the port 29 in the partition 23 and includes a margin 59 which forms a part of a poppet valve still to be disclosed.

The oil pumping and fuel/oil mixing device 11 also includes valve means associated with the port 29 and the opening 57 for selectively communicating the inlet chamber 47 with the discharge chamber 33. While various arrangements can be employed, in the illustrated construction, such means comprises a valve member or poppet 61 which is movable between open and closed positions and which is subject, at one side, to the fluid pressure in the auxiliary chamber 53 and which, on the other side, is subject to the fluid pressure in the discharge chamber 33. While various other constructions can be employed, the margin 59 of the diaphragm or piston 43 is secured to the poppet valve member 61 so as to cause common movement of the diaphragm 43 with the valve member 61 between the valve member open and closed positions.

Means are also provided for biasing the poppet valve member 61 to the closed position. While various other arrangements can be employed, in the illustrated construction, such means comprises a helical spring 63 which is located in the auxiliary chamber 53, which, at one end, bears against the poppet valve member 61 and which, at the other end, bears against a wall portion 65 of the housing.

Means are also provided for biasing the diaphragm or piston 39 so as to diminish the volume of the discharge chamber 33 and thereby bias flow of fuel/oil mixture from the discharge chamber. While various other arrangements can be employed, in the illustrated construction, such means comprises a light helical spring 67 which, at one end, bears against the underside of the discharge chamber diaphragm or piston 39 and which, at the other end, bears against a wall portion 69 of the housing 21.

Means are also provided for opening the valve member 61 in response to diminishment of the volume of the discharge chamber 33. While various other arrangements can be employed, in the illustrated construction, such means comprises a structure 71 on the discharge chamber diaphragm or piston 39 engageable with the poppet valve member 61 for displacing the poppet valve member 61 away from the port 29 and against the action of the spring 63 so as to permit flow of fuel from the inlet chamber 47 through the port 29 and into the discharge chamber 33 so as thereby to enlarge the volume of the discharge chamber 33 by action of the fuel pressure against the biasing spring 67.

Upon enlargement of the discharge chamber 33, the structure 71 moves away from the port 29 and disengages the poppet valve member 61 so as to permit gradual repositioning of the inlet chamber diaphragm or piston 43 to the position in which the port 29 is closed. Such repositioning occurs gradually in view of the restricted nature of the orifice 55.

The device 11 also includes means operative, in response to reciprocating movement of the discharge chamber diaphragm 39, for pumping oil from an oil tank or reservoir 81 into the discharge chamber 33. While other constructions can be employed, in the disclosed construction, such means comprises formation in the housing 21 of a pumping chamber 83 which extends axially in alignment with the valve opening structure 71. Still more particularly, the valve opening structure 71 forms a part of an oil pumping piston and oil delivery valve assembly 85 which is fixed to the discharge chamber diaphragm 39 so as to have common movement therewith as the discharge chamber 39 increases and decreases in volume.

The oil pumping piston and oil delivery valve assembly 85 includes a piston portion 87 which extends into the pumping chamber 83 for reciprocating movement therein so as to vary the volume of the pumping chamber 83, together with a bore 89 which extends from the oil pumping chamber 83 to the discharge chamber 33 and which includes check valve means permitting flow from the pumping chamber 83 into the discharge chamber 33 in response to decreasing volume in the oil pumping chamber 83 and which prevents flow from the discharge chamber 33 into the pumping chamber. While various check valve constructions can be employed, in the illustrated construction, such means comprises a spring biased ball check valve member 91.

It is noted that the discharge chamber diaphragm biasing spring 67 extends between the housing wall portion 69 and an adjacent surface of the oil pumping piston and oil delivering valve assembly 85.

The device 11 further includes means for supplying oil to the variable volume pumping chamber 83 and for preventing movement of the discharge chamber diaphragm 39 in the absence of an adequate supply of oil. While various arrangements can be employed, in the illustrated construction, such means comprises the reservoir or tank 81 which communicates through a conduit 93 with the oil pumping chamber 83. Located in the oil tank 81 is a float 95 having a portion 97 adapted to fit into or over the entrance to the conduit 93 so as to seal or close the conduit 93 when the oil in the tank 81 falls below a predetermined level.

Means are provided for guiding movement of the float 95 relative to the conduit entrance. While various arrangements can be employed, in the illustrated construction, such means comprises an elongated guide slot or aperture 98 in the float 95 and a guide rod 99 fixedly located in the oil tank 81 and extending through the aperture 98.

In addition, the oil supply means includes check valve means for affording supply of oil to the variable volume pumping chamber 83 in response to increasing volume thereof and for preventing flow from the pumping chamber 83 through such check valve means. While various check valve means can be employed, in the illustrated construction, such means comprises a spring biased ball check valve member 96.

Accordingly, movement of the discharge chamber diaphragm 39 accompanying expansion and contraction of the discharge chamber 33 between conditions of greater and lesser volume serves to effect oil pumping movement of the piston portion 87 in the oil pumping chamber 83. In the event the supply of oil drops below a predetermined level, the float 95 seals the entrance to the conduit 93, thereby hydraulically locking the discharge chamber diaphragm 39 against movement in the direction diminishing the volume of the discharge chamber 33. Such action causes shut-down of flow of fuel/oil mixture from the device in the absence of a sufficient availability of oil.

Shown in FIG. 2 is another oil pumping and fuel/oil mixing device 111. As in the device 11 of FIG. 1, the device 111 includes a hollow housing 121 which, in the construction shown in FIG. 2, takes the form of an upright cylinder or container including an upper wall 123, a lower wall 125 and a peripheral or outer wall 127. The housing 121 also includes an upper partition 131 defining, in part, an upper recess or oil tank 133, and defining, in part, an intermediate recess 135. In addition, the housing 121 includes a lower partition 141 which, in part, defines the intermediate recess 135 and which also, in part, defines a lower recess 143.

Located in the intermediate recess 135 is a diaphragm or piston 145 which includes a flexible membrane 147 secured peripherally to the outer peripheral wall 127 of the housing 121 and which divides the intermediate recess 135 into a lower variable volume discharge chamber 149 and an upper vent or auxiliary chamber 151. The discharge chamber 149 includes a discharge fitting 153 adapted for connection through suitable conduit means 155 with the float bowl or other part of a carburetor 157 or other means for supplying a fuel/oil mixture to the combustion chamber or chambers of a two-stroke internal combustion engine. The upper chamber 151 can be suitably vented to the atmosphere.

Located in the lower recess 143 is a second diaphragm or piston 161 which includes a flexible membrane 163 secured peripherally to the outer peripheral wall 127 of the housing 121 and which divides the lower recess 143 into an upper fuel inlet or accumulating chamber 165 and a lower or vent chamber 167. The fuel accumulating or inlet chamber 165 includes a fitting 169 which is adapted to be connected through a suitable conduit 171 to a suitable source 173 of fuel under pressure. The lower or vent chamber 167 can be suitably vented to the atmosphere.

Means are provided for guiding movement of the discharge chamber diaphragm 145 between positions minimizing and maximizing the volume of the discharge chamber 149. While various arrangements can be employed, in the illustrated construction, such means comprises formation of the discharge chamber diaphragm 145 with a guide stud or rod 175 which is received for reciprocating movement in a guide ring or tube 177 extending from the upper partition 131 into the intermediate recess 135.

Means are also provided for displacing the discharge chamber diaphragm or piston 145 toward the position minimizing the volume of the discharge chamber 149. While various arrangements can be employed, in the illustrated construction, such means comprises a helical spring 179 which, at one end, bears against the upper surface of the discharge chamber diaphragm 145 and which, at the other end bears, against the upper partition 131.

Means are provided for guiding movement of the second or accumulator chamber diaphragm 161 between positions minimizing and maximizing the volume of the accumulator or inlet chamber 165. While various arrangements can be employed, in the illustrated construction, such means comprises formation of the accumulator chamber diaphragm or piston 161 with a guide stud or rod 185 which is received for reciprocating movement in a guide ring or tube 187 extending upwardly from the lower wall 125 of the housing into the lower recess 143.

Means are also provided for biasing the accumulator chamber diaphragm 161 to the position minimizing the volume of the accumulator or inlet chamber 165. While various arrangements can be employed, in the illustrated construction, such means comprises a helical spring 189 which, at one end, bears against the under surface of the accumulator chamber diaphragm 161 and which, at the other end, bears against the bottom or lower wall 125 of the housing 121.

Means are also provided for selectively communicating the accumulator or inlet chamber 165 and the discharge chamber 149 so as to permit fuel flow from the accumulator or inlet chamber 165 to the discharge chamber 149. While various arrangements can be employed, in the illustrated construction, such means comprises a centrally located port 191 in the lower partition 141, together with a valve seat 193 surrounding the port 191, and a valve member or poppet 195 movable relative to the valve seat 193 between open and closed positions. In the illustrated construction, the valve seat 193 and valve member or poppet 195 are located in the accumulator or inlet chamber 165 although these components could be located in the discharge chamber 149.

Means are provided for guiding movement of the valve member or poppet 195 between the open and closed positions. While various arrangements can be employed, in the illustrated construction, an open cage 197 is connected to the lower partition 141, extends into the accumulator or inlet chamber 165, and cooperates with the valve member 195 during movement thereof between the open and closed positions.

Means are provided for opening the valve member 195 in response to movement of the discharge diaphragm 145 toward the position minimizing the volume of the discharge chamber 149. While various arrangements can be employed, in the illustrated construction, a valve actuator 199 extends from the discharge chamber diaphragm 145 and is engageable with the valve member 195 to displace the valve member 195 from the valve seat 193 when the discharge chamber 149 is at minimum volume. While other arrangements can be employed, in the illustrated construction, the valve actuator 199 is supported at one end of a helical spring 201 which, at its other end, is fixed to the discharge chamber diaphragm 145. The spring 201 also serves to maintain open the port 191 during initial expansion of the discharge chamber 149 from the minimum volume condition.

Means are provided for closing the valve member 195 against the valve seat 193 in response to movement of the accumulator chamber diaphragm 161 to the position minimizing the volume of the accumulator or inlet chamber 165. While various arrangements can be employed, in the illustrated construction, the valve member 195 includes a stem 203 which projects through the cage 197 inwardly of the accumulator or inlet chamber 165 for engagement with the accumulator chamber diaphragm 161 so as to effect seating of the valve member 195 against the valve seat 193 when the accumulator chamber diaphragm 161 is in the position minimizing the volume of the accumulator or inlet chamber 165.

Means are provided for supplying oil to the fuel exiting from the discharge chamber 149 in response to the movement of the discharge chamber diaphragm 145 between the positions minimizing and maximizing the volume of the discharge chamber 149 and for preventing movement of the discharge chamber diaphragm 145 in the absence of the presence of a suitable quantity of oil in the oil reservoir or tank 133.

While various arrangements can be employed, in the illustrated construction, the upper partition 131 includes a port 295 which communicates with the oil tank 133 through a suitable oil supply passage 297 and with a variable volume oil pumping chamber 299 defined between the guide ring 177 and the discharge chamber diaphragm stud or rod 175. Movement of the discharge chamber diaphragm stud or rod 175 accompanying movement of the discharge chamber diaphragm 145 between the positions minimizing and maximizing the volume of the discharge chamber 149 causes associated variation in the volume of the pumping chamber 299.

Means are provided for affording inflow of oil from the tank 133 into the pumping chamber 299 in response to an increase of volume in the pumping chamber 299 and for preventing outflow from the pumping chamber 299 back to the tank 133. While various arrangements can be employed, in the illustrated construction, such means comprises a check valve in the oil supply passage 297, which check valve 301 is in the form of a spring biased ball member 301 located in an enlarged portion or valve chamber 303 and operative relative to an adjacent seat 305 in the oil supply passage 297.

Means are provided for affording outflow of oil from the pumping chamber 299 and into the discharge chamber 149 in response to a decrease in the volume of the pumping chamber 299 and for preventing outflow from the discharge chamber 149 back into the pumping chamber 299. While various arrangements can be employed, in the illustrated construction, such means comprise a bore 307 in the stud or rod 175, which bore 307 communicates with the pumping chamber 299 and with the discharge chamber 149 and which bore 307 includes check valve means in the form of a spring biased ball member 309 located in an enlarged portion or valve chamber 311 of the bore 307 and operative relative to an adjacent seat 313.

Means are also provided, as noted above, for preventing movement of the discharge chamber diaphragm 145 in the direction minimizing the volume of the discharge chamber 149 in the absence of a suitable supply of oil in the tank 133. While various arrangements can be employed, in the illustrated construction, such means comprises a float operated valve means including a lever 315 pivotly mounted in the tank 133, a float 317 on the lever 315, and a valve member in the form of a ball 319 carried on the lever 315 and movable relative to the upper or entrance end of the supply passage 297 so as to close the passage 297 when the oil level drops below a preselected level.

In operation, drainage of fuel/oil mixture by the carburetor 157 or by some other fuel using device serves, together with the action of the discharge chamber biasing spring 179, to cause movement of the discharge chamber diaphragm 145 in the direction minimizing the volume of the discharge chamber 149 until the actuator 199 engages the valve member 195 to effect opening thereof. During such movement of the discharge chamber diaphragm 145, the incoming fuel under pressure causes movement of the accumulator chamber diaphragm 161, against the action of the accumulator chamber diaphragm biasing spring 189, to a position maximizing the volume of the accumulator or inlet chamber 165. When the valve member 195 opens, fuel flows from the accumulator chamber 165 to the discharge chamber 149 causing movement of the discharge chamber diaphragm 145 to the position maximizing the volume of the discharge chamber 149, and simultaneously permitting movement of the accumulator chamber diaphragm biasing spring 189 to the position minimizing the volume of the accumulator or inlet chamber 165.

Such movement also engages the accumulator chamber diaphragm with the stem 203 of the valve member 195 to again cause the valve member 195 to close and to commence the initiation of another operating cycle.

During movement of the discharge chamber diaphragm 145 to the position minimizing the volume of the discharge chamber 149, the oil pumping chamber 299 expands, drawing oil thereinto from the oil tank 133. During movement of the discharge chamber diaphragm 145 to the position maximizing the volume of the discharge chamber 149, the volume of the pumping chamber 299 decreases, thereby forcing oil into the discharge chamber 149.

When the ball shaped valve member 319 seats on the entrance to the oil supply passage 297, due to an insufficient supply of oil in the tank 133, oil supply to the oil pumping chamber 299 is prevented and movement of the discharge chamber diaphragm 145 in the direction toward the position minimizing the volume of the discharge chamber is prevented, thereby preventing further operation of the device 111 and ultimately causing discontinuance of engine operation due to a lack of fuel.

If desired, discharge chamber movement could be used to supply oil to the conduit 155, or to the carburetor 157 or to some other place in the fuel supply system to the engine.

Various of the features of the invention are set forth in the following claims.

I claim:

1. A combined oil pumping and fuel supplying device comprising a housing including means defining a variable volume discharge chamber which is adapted for fluid communication with a point of use and which varies in volume between a greater volume and a lesser volume, means defining an inlet chamber which is adapted to communicate with a source of fuel under pressure and which varies in volume between a larger volume and a smaller volume, valve means communicating between said discharge chamber and said inlet chamber and operable between open and closed positions, means displacing said valve means to said open postion in response to contraction of said discharge chamber to said lesser volume, means displacing said valve means to said closed position in response to contraction of said inlet chamber to said smaller volume, and means responsive to variation in volume of one of said discharge chamber and said inlet chamber for pumping oil for supply to a point of use.

2. A combined oil pumping and fuel supplying device in accordance with claim 1 and further including means for preventing volume variation of one of said discharge chamber and said inlet chamber in the absence of available oil supply to said oil pumping means.

3. A combined oil pumping and fuel supplying device in accordance with claim 2 wherein said means for preventing volume variation of one of said discharge chamber and said inlet chamber comprises an oil tank, a passage communicating between said oil tank and said oil pumping means, and valve means closing said passage in response to reduction below a predetermined level of the oil in said oil tank.

4. A combined oil pumping and fuel supplying device in accordance with claim 1 and further including means biasing said discharge chamber to said lesser volume.

5. A combined oil pumping and fuel supplying device in accordance with claim 1 and further including means biasing said inlet chamber to said smaller volume.

6. A combined oil pumping and fuel supplying device in accordance with claim 1 wherein said oil pumping means includes a pumping chamber which varies in volume in response to variation in volume of one of said chambers and which selectively communicates with one of said chambers so as to deliver thereto oil from said pumping chamber.

7. A combined oil pumpng and fuel supplying device in accordance with claim 1 wherein said discharge chamber is formed, in part, by a movable wall.

8. A combined oil pumping and fuel supplying device in accordance with claim 1 wherein said inlet chamber is formed, in part, by a movable wall.

9. A combined oil pumping and fuel supplying device in accordance with claim 1 wherein said housing includes a partition separating said discharge chamber and said inlet chamber, wherein said valve means includes a port in said partition and a valve member movable relative to said port between open and closed position, wherein said inlet chamber is formed, in part, by a movable wall having therein an orifice and including said valve member, wherein said housing further defines, in combination with said movable wall, an auxiliary chamber, and further including means in said auxiliary chamber biasing said movable wall so as to locate said valve member in said closed position.

10. A combined oil pumping and fuel supplying device in accordance with claim 1 wherein said housing includes a partition separating said discharge chamber and said inlet chamber, wherein said valve means includes a port in said partition and a valve member movable relative to said port between open and closed positions, wherein said inlet chamber is formed, in part, by a movable wall having thereon means engageble with said valve member for displacing said valve member to one of said open and closed positions in response to displacement of said inlet chamber moveable wall to a position establishing one of said inlet chamber smaller and larger volumes, and wherein said discharge chamber is formed, in part, by a movable wall having thereon means engageable with said valve member for displacing said valve member to the other of said open and closed positions in response to displacement of said discharge chamber movable wall to a position establishing one of said discharge chamber lesser and greater volumes.

11. A combined oil pumping and fuel supplying device comprising a housing including a central partition, said housing also including first wall means including said central partition and a first movable wall defining a variable volume discharge chamber adapted for fluid communication with a point of use, said discharge chamber varying in volume between a greater volume and a lesser volume, said housing also including second wall means including said central partition and a second movable wall defining an inlet chamber which is adapted to communicate with a source of fuel under pressure, said second movable wall having therein an orifice, said housing and said second movable wall also defining a regulator chamber communicating through said orifice with said inlet chamber, valve means communicating between said discharge chamber and said inlet chamber and including a port in said central partition and a valve member forming a part of said second movable wall and movable relative to said port between open and closed positions, means in said regulator chamber biasing said second movable wall so as to locate said valve member in said closed position, engageable means on said valve member and on said first movable wall for displacing said valve member to said open position in response to contraction of said discharge chamber to said lesser volume, and means responsive to variation in volume of one of said discharge chamber and said inlet chamber for pumping oil for supply to a point of use.

12. A combined oil pumping and fuel supplying device in accordance with claim 11 and further including means for preventing volume variation of one of said discharge chamber and said inlet chamber in the absence of available oil supply to said oil pumping means.

13. A combined oil pumping and fuel supplying device in accordance with claim 12 wherein said means for preventing variation in volume of one of said discharge chamber and said inlet chamber comprises an oil tank, a passage communicating between said oil tank and said pumping means, and valve means closing said passage in response to reduction below a predetermined level of the oil in said oil tank.

14. A combined oil pumping and fuel supplying device comprising a housing including a central partition, said housing also including first wall means including said central partition and a first movable wall defining a variable volume discharge chamber adapted for fluid communication with a point of use, said discharge chamber varying in volume between a greater volume and a lesser volume, said housing also including second wall means including said central partition and a second movable wall defining an inlet chamber which is adapted to communicate with a source of fuel under pressure and which is variable in volume between a larger volume and a smaller volume, means biasing said discharge chamber to said lesser volume, means biasing said inlet chamber to said smaller volume, valve means communicating between said discharge chamber and said inlet chamber and including a port in said central partition, and a valve member movable relative to said port between open and closed positions, said valve member being engageable by said first movable wall so as to displace said valve member to said open position in response to contraction of said discharge chamber to said lesser volume, said valve member being engageable by said second movable wall so as to displace said valve member to said closed position in response to contraction of said inlet chamber to said smaller volume, and means responsive to variation in volume of one of said discharge chamber and said inlet chamber for pumping oil for supply to a point of use.

15. A combined oil pumping and fuel supplying device in accordance with claim 14 and further including means for preventing volume variation of one of said discharge chamber and said inlet chamber in the absence of available oil supply to said oil pumping means.

16. A combined oil pumping and fuel supplying device in accordance with claim 15 wherein said means for preventing variation in volume of one of said discharge chamber and said inlet chamber comprises an oil tank formed in said housing, a passage communicating between said oil tank and said oil pumping means, and valve means closing said passage in response to reduction below a predetermined level of the oil in said oil tank.

17. A combined oil pumping and fuel supplying device in accordance with claim 16 wherein said oil pumping means includes a pumping chamber which is formed in said housing and which varies in volume in response to variation in volume of one of said chambers and which selectively communicates with one of said chambers so as to deliver thereto oil from said pumping chamber.

* * * * *